US010389071B2

(12) United States Patent
Li et al.

(10) Patent No.: US 10,389,071 B2
(45) **Date of Patent: *Aug. 20, 2019**

(54) MOBILE TERMINAL AND METHOD FOR MANUFACTURING EARPHONE SOCKET

(71) Applicant: GUANGDONG OPPO MOBILE TELECOMMUNICATIONS CORP., LTD., Dongguan, Guangdong (CN)

(72) Inventors: Feifei Li, Guangdong (CN); Hanjie Huang, Guangdong (CN)

(73) Assignee: GUANGDONG OPPO MOBILE TELECOMMUNICATIONS CORP., LTD., Dongguan, Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/180,616

(22) Filed: Nov. 5, 2018

(65) Prior Publication Data

US 2019/0074646 A1 Mar. 7, 2019

Related U.S. Application Data

(63) Continuation of application No. 15/646,636, filed on Jul. 11, 2017, now Pat. No. 10,153,601.

(30) Foreign Application Priority Data

Oct. 13, 2016 (CN) ..... 2016 1 0894343
Oct. 13, 2016 (CN) ..... 2016 2 1119915 U

(51) Int. Cl.
*H01R 13/52* (2006.01)
*H01R 24/58* (2011.01)
(Continued)

(52) U.S. Cl.
CPC ..... *H01R 24/58* (2013.01); *H01R 13/5202* (2013.01); *H01R 13/523* (2013.01); *H01R 13/5219* (2013.01); *H01R 2107/00* (2013.01)

(58) Field of Classification Search
CPC .... H01R 24/58; H01R 24/60; H01R 13/5205; H01R 24/62
See application file for complete search history.

(56) References Cited

U.S. PATENT DOCUMENTS 9,729,686 B2 * 8/2017 Chung ..... H04M 1/0277
2004/0242076 A1 * 12/2004 Nakai ..... H01R 24/40 439/668

(Continued)

*Primary Examiner* — Abdullah A Riyami
*Assistant Examiner* — Nader J Alhawamdeh
(74) *Attorney, Agent, or Firm* — Lathrop Gage LLP

(57) ABSTRACT

The present disclosure provides a mobile terminal and a method for manufacturing an earphone socket. The mobile terminal includes an earphone socket. The earphone socket includes a housing and a sealing member. The housing has an insertion hole surrounded by a peripheral side wall, the peripheral side wall has a first peripheral side wall located at an inner portion of the insertion hole and a second peripheral side wall located at an outer portion of the insertion hole, the first peripheral side wall has a thickness greater than that of the second peripheral side wall, and the second peripheral side wall has an opening port at an outer end of the insertion hole. The sealing member is embedded on an outer surface of the housing, and surrounds a periphery of the opening port, and at least a part of the sealing member extends to the first peripheral side wall.

19 Claims, 4 Drawing Sheets

(51) Int. Cl.
*H01R 107/00* (2006.01)
*H01R 13/523* (2006.01)

(56) References Cited

U.S. PATENT DOCUMENTS

| | | | | |
|---|---|---|---|---|
| 2009/0011628 | A1* | 1/2009 | Purchon | H01R 13/7031 439/188 |
| 2009/0061694 | A1* | 3/2009 | Kawasaki | H01R 13/5219 439/669 |
| 2014/0273617 | A1* | 9/2014 | Cheong | H01R 13/5213 439/521 |
| 2015/0173245 | A1* | 6/2015 | Chung | H04M 1/0277 361/714 |
| 2015/0230348 | A1* | 8/2015 | Yoon | H01R 24/58 361/796 |
| 2016/0336678 | A1* | 11/2016 | Choi | H01R 13/5202 |

* cited by examiner

MOBILE TERMINAL AND METHOD FOR MANUFACTURING EARPHONE SOCKET

CROSS-REFERENCE TO RELATED APPLICATIONS

This application is a Continuation Application of U.S. application Ser. No. 15/646,636, filed Jul. 11, 2017 and which claims priority to and benefits of Chinese Patent Application No. 201610894343.6, filed with State Intellectual Property Office on Oct. 13, 2016, and Chinese Patent Application No. 201621119915.5, filed with State Intellectual Property Office on Oct. 13, 2016, the entire contents of which are incorporated herein by reference.

FIELD

The present disclosure relates to a technical field of mobile terminals, and particularly, to a mobile terminal and a method for manufacturing an earphone socket.

BACKGROUND

In the related art, an earphone socket is used as a main adapter for electrical signal transmission in all types of electronic products, specially provided as an audio connector for audio signal output/input and more widely applied in various kinds of audiovisual products. In particular, with the rapid development of a variety of portable electronic products, such as mobile phones, personal digital assistants (PAD), MP3 players, recording pens, and notebook computers, earphones with various sizes have been extensively used in those products in recent years, and hence people are more demanding on waterproofness of the earphone socket. However, in the related art, a waterproof structure of the earphone socket is complex and occupies a large internal space, which is not conductive to a light and thin design of the electronic products.

SUMMARY

The present disclosure provides a mobile terminal, including an earphone socket and a display screen, the display screen being spaced apart from the earphone socket. The earphone socket according to embodiments of present disclosure includes: a housing having an insertion hole surrounded by a peripheral side wall and provided with an embedding groove, the peripheral side wall having a first peripheral side wall located at an inner portion of the insertion hole and a second peripheral side wall located at an outer portion of the insertion hole, the first peripheral side wall having a thickness greater than that of the second peripheral side wall, and the second peripheral side wall having an opening port at an outer end of the insertion hole; and a sealing member embedded on an outer surface of the housing, and surrounding a periphery of the opening port, and at least a part of the sealing member extending to the first peripheral side wall. The housing includes a first surface including a surface of a part of the second peripheral side wall, and a second surface comprising a surface of another part of the second peripheral side wall and a part of the first peripheral side wall; the first surface is adjacent to the second surface; the opening port is located in the first surface. The sealing member includes: a first segment embedded on the first surface and close to the opening port; a second segment embedded on the second surface; and two connecting segments connected between the first segment and the second segment to constitute a ring sealing member.

The present disclosure furthermore provides a method for manufacturing an earphone socket.

In the method according to embodiments of the present disclosure, an earphone socket includes a housing and a sealing member embedded on an outer surface of the housing; the housing is provided with an insertion hole having an open end; and the sealing member surrounds a periphery of the insertion hole. The method includes actions of: machining an embedding groove in the housing and embedding the sealing member in the embedding groove; forming at least one embedding recess in communication with the embedding groove in the embedding groove; and filling glue in the embedding recess, and coagulating the glue to form a glue portion so as to fix the sealing member on the housing.

DETAILED DESCRIPTION

Figure 1:
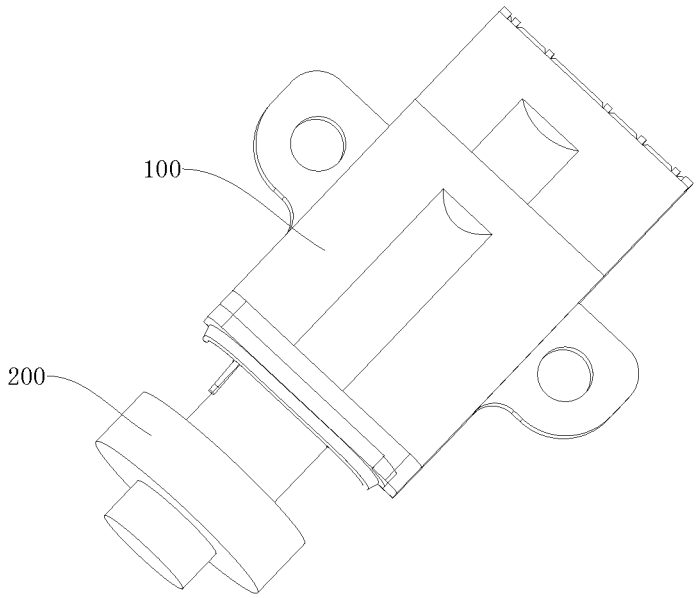
FIG. 1 is a schematic view of an earphone socket according to an embodiment of the present disclosure.

Reference will be made in detail to embodiments of the present disclosure. Examples of the embodiments are illustrated in the drawings. The embodiments described herein with reference to drawings are explanatory, and used to interpret the present disclosure. The embodiments shall not be construed to limit the present disclosure.

In the specification, it is to be understood that terms such as "central," "length," "width," "thickness," "upper," "lower," "front," "rear," "left," "right," "inner," "outer" and "circumferential" should be construed to refer to the orientations or positions as described or as illustrated in the drawings under discussion. These relative terms are for convenience of description and do not indicate or imply that the device or element referred to must have a particular orientation or be constructed or operated in a particular orientation. Thus, the relative terms shall not be construed to limit the present disclosure.

In addition, terms such as "first" and "second" are used herein for purposes of description and are not intended to indicate or imply relative importance or significance or to imply the number of indicated technical features. Thus, the feature defined with "first" and "second" can comprise one or more of this feature. In the description of the present disclosure, "a plurality of" means two or more than two, unless specified otherwise.

In the present disclosure, unless specified or limited otherwise, the terms "mounted", "connected", "coupled", "fixed" and the like are used broadly, and can be, for example, fixed connections, detachable connections, or integral connections; can also be mechanical or electrical connections; can also be direct connections or indirect connections via intervening structures; can also be inner communications of two elements, which can be understood by those skilled in the art according to specific situations.

The present disclosure provides a mobile terminal, including an earphone socket and a display screen, the display screen being spaced apart from the earphone socket. The earphone socket according to embodiments of present disclosure includes: a housing having an insertion hole surrounded by a peripheral side wall and provided with an embedding groove, the peripheral side wall having a first peripheral side wall located at an inner portion of the insertion hole and a second peripheral side wall located at an outer portion of the insertion hole, the first peripheral side wall having a thickness greater than that of the second peripheral side wall, and the second peripheral side wall having an opening port at an outer end of the insertion hole; and a sealing member embedded on an outer surface of the housing, and surrounding a periphery of the opening port, and at least a part of the sealing member extending to the first peripheral side wall. The housing includes a first surface including a surface of a part of the second peripheral side wall, and a second surface comprising a surface of another part of the second peripheral side wall and a part of the first peripheral side wall; the first surface is adjacent to the second surface; the opening port is located in the first surface. The sealing member includes: a first segment embedded on the first surface and close to the opening port; a second segment embedded on the second surface; and two connecting segments connected between the first segment and the second segment to constitute a ring sealing member.

The present disclosure furthermore provides a method for manufacturing an earphone socket.

In the method according to embodiments of the present disclosure, an earphone socket includes a housing and a sealing member embedded on an outer surface of the housing; the housing is provided with an insertion hole having an open end; and the sealing member surrounds a periphery of the insertion hole. The method includes actions of: machining an embedding groove in the housing and embedding the sealing member in the embedding groove; forming at least one embedding recess in communication with the embedding groove in the embedding groove; and filling glue in the embedding recess, and coagulating the glue to form a glue portion so as to fix the sealing member on the housing.

In the following, an earphone socket 100 according to embodiments of the present disclosure will be described with reference to FIGS. 1 to 8.

FIGS. 1 to 8 illustrate the earphone socket 100 according to embodiments of the present disclosure. The earphone socket includes a housing 1 and a sealing member 2.

In an embodiment, the housing 1 has an insertion hole 13 surrounded by a peripheral side wall, the peripheral side wall has a first peripheral side wall 12 located at an inner portion of the insertion hole 13 and a second peripheral side wall 11 located at an outer portion of the insertion hole 13. The first peripheral side wall 12 has a wall thickness greater than a wall thickness of the second peripheral side wall 11, and the first peripheral side wall 12 and the second peripheral side wall 11 together define the insertion hole 13, the second peripheral side wall 11 has an opening port 131 at an outer end of the insertion hole. An earphone plug 200 can be inserted into the insertion hole 13. The first peripheral side wall 12 and the second peripheral side wall 11 are arranged along a central axis of the insertion hole 13, and the opening port 131 is located in the second peripheral side wall 11. That is, the first peripheral side wall 12 and the second peripheral side wall 11 are arranged along the central axis of the insertion hole 13, and the opening port 131 is located in the second peripheral side wall 11.

The sealing member 2 is embedded on an outer surface of the housing 1. The sealing member 2 surrounds a periphery of the opening port 131, and at least part of the sealing member 2 extends to the first peripheral side wall 12. The sealing member 2 is embedded on the outer surface of the housing 1 and surrounds the periphery of the opening port 131, such that it is possible to prevent water outside a mobile terminal 1000 from flowing to an interior of the mobile terminal 1000 along the outer surface of the housing 1 of the earphone socket 100, and hence avoid damaging a circuit board or the like inside the mobile terminal 1000. In addition, at least part of the sealing member 2 extends to the first peripheral side wall 12, and since the sealing member 2 is embedded on the housing 1 through a sealing groove (as an embedding groove 14 described below), at least part of the sealing groove can be provided in the first peripheral side wall 12 when at least part of the sealing member 2 extends to the first peripheral side wall 12; since the thickness of the first peripheral side wall 12 is greater than that of the second peripheral side wall 11, there is no need to increase the wall thickness of the second peripheral side wall 11 and form the sealing groove in the second peripheral side wall 11, so as to reduce an overall thickness of the earphone socket 100 and facilitate a light and thin design of the mobile terminal 1000. Meanwhile, at least part of the sealing groove can be provided in the first peripheral side wall 12, which can enhance a structural strength of the housing 1, improve operational reliability of the mobile terminal 1000, and improve waterproof and dustproof reliability of the earphone socket 100.

Figure 4:
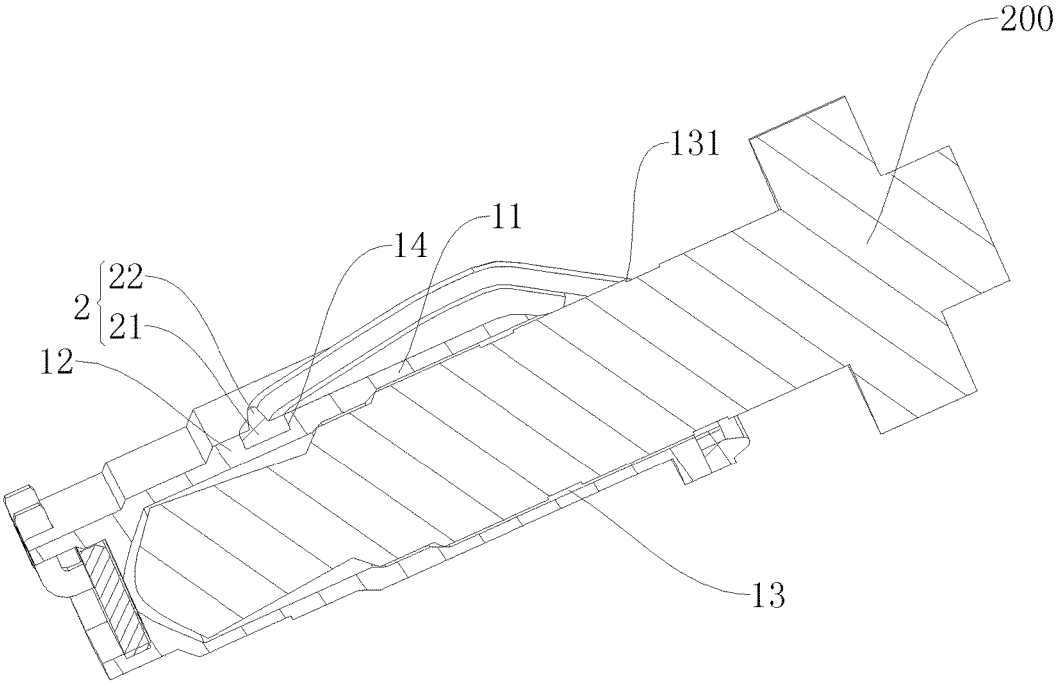
FIG. 4 is a sectional view of an earphone socket according to an embodiment of the present disclosure.
Figure 5:
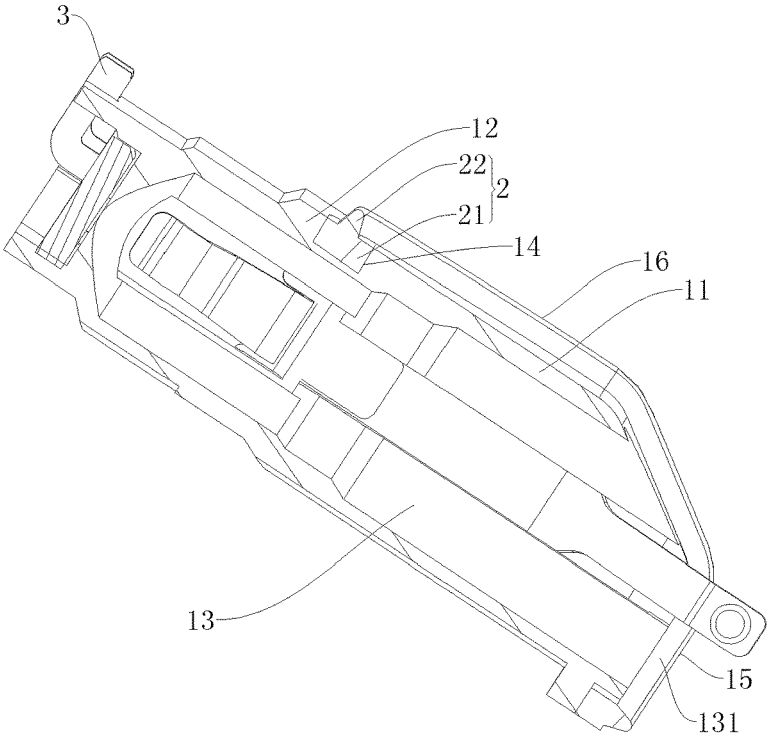
FIG. 5 is a sectional view of an earphone socket according to an embodiment of the present disclosure.

FIGS. 4 and 5 illustrate the housing 1 including the first peripheral side wall 12 and the second peripheral side wall 11; the first peripheral side wall 12 is connected with the second peripheral side wall 11; the thickness of the first peripheral side wall 12 is greater than that of the second peripheral side wall 11; the first peripheral side wall 12 and the second peripheral side wall 11 together define the insertion hole 13 with the opening port 131 at one end; and the opening port 131 is located in the second peripheral side wall 11. The sealing member 2 is embedded on the outer surface of the housing 1 and surrounds the periphery of the opening port 131, so as to prevent a fluid (e.g. water) outside the mobile terminal 1000 from entering the mobile terminal 1000 along the outer surface of the housing 1, and hence avoid damaging the circuit board or the like inside the mobile terminal 1000. In addition, at least part of the sealing member 2 extends to the first peripheral side wall 12, and correspondingly, at least part of the sealing groove extends to the first peripheral side wall 12; since the thickness of the first peripheral side wall 12 is greater than that of the second peripheral side wall 11, there is no need to increase the wall thickness of the second peripheral side wall 11 and form the sealing groove in the second peripheral side wall 11, so as to reduce the overall thickness of the earphone socket 100 and facilitate the light and thin design of the mobile terminal 1000. Meanwhile, it is possible to enhance the structural strength of the housing 1, and improve the waterproof and dustproof reliability of the earphone socket 100.

For the earphone socket 100 according to embodiments of the present disclosure, by configuring the thickness of the first peripheral side wall 12 of the housing 1 to be greater than the thickness of the second peripheral side wall 11 of the housing 1 and configuring the sealing member 2 to extend along the periphery of the opening port 131 with at least part of the sealing member 2 extending to the first peripheral side wall 12, the fluid (e.g. water) outside the mobile terminal 1000 can be prevented from entering the mobile terminal 1000 along the outer surface of the housing 1, and hence the circuit board or the like inside the mobile terminal 1000 can be protected from damages, thereby improving the operational reliability of the mobile terminal 1000. Furthermore, there is no need to increase the wall thickness of the second peripheral side wall 11 and form the sealing groove in the second peripheral side wall 11, so as to reduce the overall thickness of the earphone socket 100 and facilitate the light and thin design of the mobile terminal 1000. Moreover, it is possible to enhance the structural strength of the housing 1, and improve the waterproof and dustproof reliability of the earphone socket 100.

Figure 7:
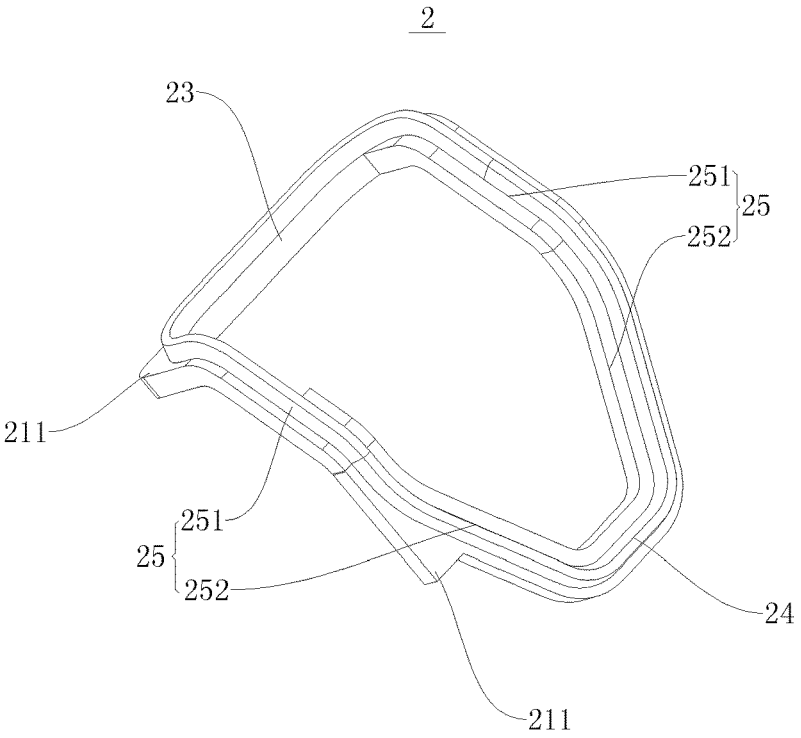
FIG. 7 is a schematic view of a sealing member of an earphone socket according to an embodiment of the present disclosure.
Figure 8:
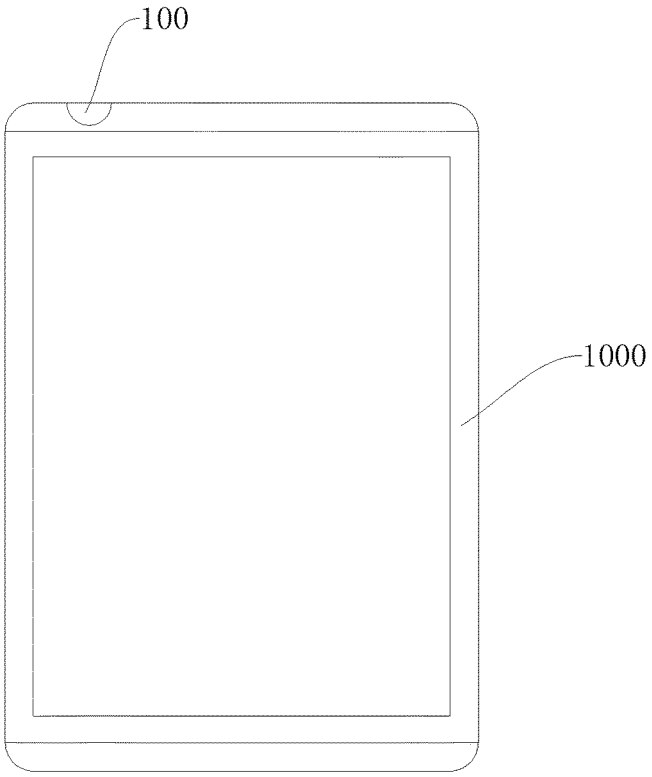
FIG. 8 is a schematic view of a mobile terminal according to an embodiment of the present disclosure.

In some embodiments of the present disclosure, as illustrated in FIGS. 4, 5 and 7, the housing 1 is provided with the embedding groove 14, and the sealing member 2 includes an embedded portion 21 and a protruding portion 22. The embedded portion 21 is embedded in the embedding groove 14, so as to realize fixation of the sealing member 2. The protruding portion 22 is connected with the embedded portion 21 and located outside the embedding groove 14. When the sealing member 2 is embedded into the embedding groove 14 and after that the earphone socket 100 is assembled into the mobile terminal 1000, a free end of the protruding portion 22 can be in contact with an outer wall of a component inside the mobile terminal 1000, so as to separate the interior of the mobile terminal 1000 from the exterior thereof. Therefore, it is possible to prevent the fluid (e.g. water) outside the mobile terminal 1000 from entering the mobile terminal 1000 along the outer surface of the housing 1, and hence avoid damaging the circuit board or the like inside the mobile terminal 1000; it is possible to prevent dust from entering the mobile terminal 1000 along the outer surface of the housing 1, and hence improve the waterproof and dustproof reliability of the earphone socket 100, thereby enhancing the operational reliability of the mobile terminal 1000.

In some embodiments, as illustrated in FIGS. 4 and 5, an end face of the free end of the protruding portion 22 has an arc surface. As illustrated in FIGS. 4 and 5, the arc surface of the end face of the free end of the protruding portion 22 protrudes in a direction away from the embedded portion 21, such that when the end face of the free end of the protruding portion 22 is in contact with the outer surface of the component inside the mobile terminal 1000 to prevent the fluid (e.g. water) outside the mobile terminal 1000 from entering the mobile terminal 1000, the reliability of contact fitting between the protruding portion 22 and the outer surface of the component inside the mobile terminal 1000 can be improved, and hence prevent the fluid (e.g. water) outside the mobile terminal 1000 from entering the mobile terminal 1000 through a gap between the protruding portion 22 and the outer surface of the component inside the mobile terminal 1000, thereby avoiding damaging the circuit board or the like inside the mobile terminal 1000, so as to improve the operational reliability of the mobile terminal 1000.

In at least one embodiment, as illustrated in FIGS. 4 and 5, in a direction from a fixed end of the protruding portion 22 to the free end of the protruding portion 22, a width of the protruding portion 22 is gradually decreased. When the end face of the free end of the protruding portion 22 is in contact with the outer surface of the component inside the mobile terminal 1000 to prevent the fluid (e.g. water) outside the mobile terminal 1000 from entering the mobile terminal 1000, it is possible to improve the reliability of contact fitting between the protruding portion 22 and the outer surface of the component inside the mobile terminal 1000, and hence prevent the fluid (e.g. water) outside the mobile terminal 1000 from entering the mobile terminal 1000 through the gap between the protruding portion 22 and the outer surface of the component inside the mobile terminal 1000, thereby avoiding damaging the circuit board or the like inside the mobile terminal 1000, so as to improve the operational reliability of the mobile terminal 1000.

As illustrated in FIG. 7, the embedding groove 14 is provided with at least one embedding recess therein in communication with the embedding groove 14, and the sealing member 2 is provided with an embedded protrusion 211 fitted with the embedding recess. Therefore, it is possible to increase a mating area between the sealing member 2 and the outer surface of the housing 1, enhance reliability of fixing the sealing member 2 on the outer surface of the housing 1, and hence improve the waterproof and dustproof reliability of the earphone socket 100. For instance, in an example illustrated in FIG. 7, the embedded portion 21 is provided with a plurality of embedded protrusions 211; the plurality of embedded protrusions 211 are spaced apart in a circumferential direction of the sealing member 2, connected with the embedded portion 21, and located at a side of the embedded portion 21 away from the opening port 131. Therefore, the plurality of embedded protrusions 211 can be embedded on the outer surface of the housing 1, thus enhancing the reliability of fitting between the embedded portion 21 and the outer surface of the housing 1 and hence enhancing the reliability of fixing the sealing member 2 on the outer surface of the housing 1, so as to improve the waterproof and dustproof reliability of the earphone socket 100. When the earphone socket 100 is machined, the sealing member 2 can be injection-molded into the embedding groove 14 together with the embedded protrusion 211.

In some embodiments of the present invention, the embedding groove 14 is provided with at least one embedding recess therein in communication with the embedding groove 14, and the embedding recess is provided with a glue portion therein for bonding the sealing member 2 to the housing 1. The sealing member 2 and the housing 1 can be two individually fabricated structures; after they are fabricated individually, the sealing member 2 can be placed into the embedding groove 14 in the housing 1; then the embedding groove is filled with glue, and the glue is coagulated in the embedding groove to form the glue portion. The glue portion can fix the sealing member 2 in the embedding groove 14, which enhances the reliability of fixing the sealing member 2 on the outer surface of the housing 1, and improves the waterproof and dustproof reliability of the earphone socket 100. In addition, it is possible to simplify a machining process and reduce cost by fabricating the sealing member 2 and the housing 1 individually and assembling them together.

In some embodiments of the present disclosure, the sealing member 2 is injection-molded on the housing 1. Thus, the sealing member 2 can be directly injection-molded on the housing 1, and a process assembling the sealing member 2 and the housing 1 can be simplified.

Figure 2:
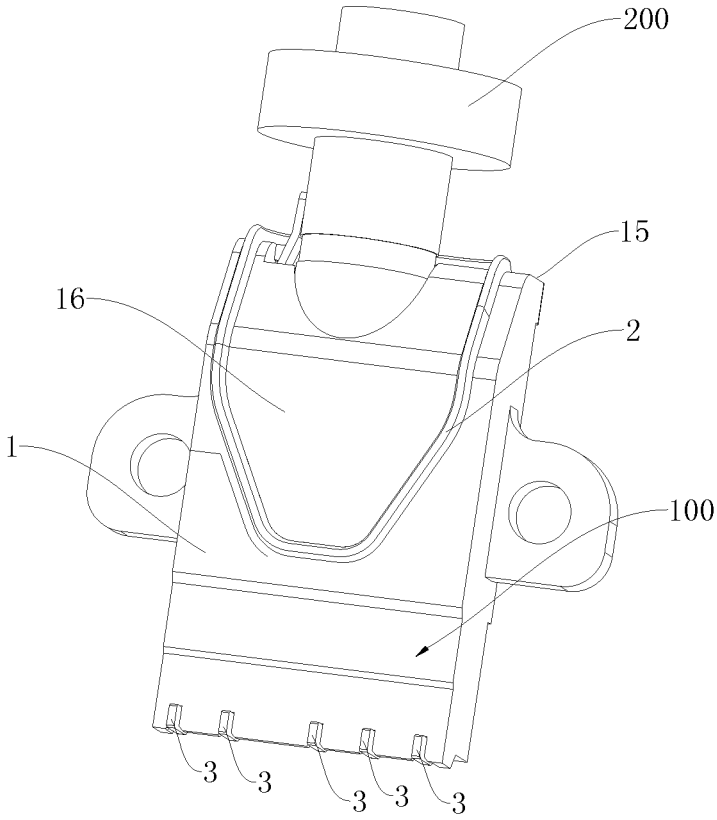
FIG. 2 is a schematic view of an earphone socket from another angle according to an embodiment of the present disclosure.

In some embodiments of the present disclosure, as illustrated in FIGS. 2 and 5, the housing 1 has a first surface 15 including a surface of a part of the second peripheral side wall 11, and a second surface 16 including a surface of another part of the second peripheral side wall 11 and a surface of a part of the first peripheral side wall 12. The first surface 15 is adjacent to the second surface 16, and the opening port 131 is located in the first surface 15 to facilitate insertion of the earphone plug 200 into the insertion hole 13. The sealing member 2 includes a first segment 23, a second segment 24 and two connecting segments 25. The first segment 23 is embedded on the first surface 15 and is close to the opening port 131; the second segment 24 is embedded on the second surface 16; the two connecting segments 25 are connected between the first segment 23 and the second segment 24 to constitute a ring sealing member 2. The structure of the sealing member 2 becomes more flexible by designing the sealing member 2 in a form of multi-segment connection, and the sealing member 2 can be designed reasonably according to the shape of the outer surface of the housing 1, thus achieving a better waterproof and dustproof effect.

Further, as illustrated in FIG. 2, the first segment 23 and the second segment 24 extend in the same direction, so as to facilitate the machining of the embedding process 14, simplify the structure and machining process of the housing 1, shorten a production cycle and reduce a production cost. A length of the first segment 23 is greater than a length of the second segment 24. The first segment 23 is embedded on the first surface 15 and located at one side of the opening port 131, and the second segment 24 is embedded on the second surface 16 and located at the other side of the opening port 131. The length of the first segment 23 is greater than that of the second segment 24, and correspondingly, a first part of the embedding groove 14 for containing the first segment 23 has a length greater than a length of a second part of the embedding groove 14 for containing the second segment 24, such that the opening port 131 is surrounded by the sealing member 2 to achieve waterproof and dustproof characteristics of the earphone socket 100, and the length of the second part of the embedding groove 14 for containing the second segment 24 can be reduced to enhance the structural strength of the housing 1, thereby improving the waterproof and dustproof reliability of the earphone socket 100.

As illustrated in FIGS. 2 and 7, each connecting segment 25 includes a straight segment 251 and a transition segment 252. A first end of the straight segment 251 is connected with the first segment 23, and an extension direction of the straight segment 251 is perpendicular to an extension direction of the first segment 23. Since the straight segment 251 is close to the opening port 131, when the extension direction of the straight segment 251 is configured to be perpendicular to that of the first segment 23, a structure of a third part of the embedding groove 14 for containing the straight segment 251 can be simplified, thus simplifying the structure and machining process of the housing 1, shortening the production cycle and reducing the production cost. Moreover, the first segment 23 and the straight segment 251 can define enough space to surround the opening port 131, so as to prevent the fluid (e.g. water) outside the mobile terminal 1000 from entering the mobile terminal 1000, and hence avoid damaging the circuit board or the like inside the mobile terminal 1000.

A first end of the transition segment 252 is connected with a second end of the straight segment 251, and a second end of the transition segment 252 is connected with the second segment 24. In a direction towards an interior of the insertion hole 13, the transition segment 252 is gradually inclined towards the central axis of the insertion hole 13. Thus, it is convenient to connect the transition segment 252 with the second segment 24 to shape the sealing member 2 into a ring, thereby realizing a waterproof and dustproof function of the sealing member 2. When the earphone socket 100 is mounted to the mobile terminal 1000, the sealing member 2 can prevent the fluid (e.g. water) outside the mobile terminal 1000 from entering the mobile terminal 1000, and hence avoid damaging the circuit board or the like inside the mobile terminal 1000, so as to improve the operational reliability of the mobile terminal 1000.

In some embodiments of the present disclosure, as illustrated in FIG. 2, a part of the second surface 16 close to the first surface 15 is formed as an inclined surface, so as to adapt to an arc design of a housing of the mobile terminal 1000 and the like to make the appearance of the mobile terminal 1000 and the like more beautiful. Certainly, the part of the second surface 16 close to the first surface 15 can also be formed as an arc surface, so as to adapt to an arc design of the housing of the mobile terminal 1000 and the like to make the appearance of the mobile terminal 1000 and the like more beautiful.

In some embodiments of the present disclosure, the sealing member 2 is made of silica gel. Silica gel is a high-active adsorbent material and an amorphous substance. Silica gel does not react with any other substance except strong alkali and hydrofluoric acid, and dissolve in water and any solvents. Silica gel is non-toxic, odorless and chemically stable. Silica gel has the advantages of high adsorption performance, good thermal stability, stable chemical properties, high mechanical strength and so on. Thus, the reliability of the sealing member 2 can be enhanced, and the waterproof and dustproof effect of the sealing member can be improved.

Figure 3:
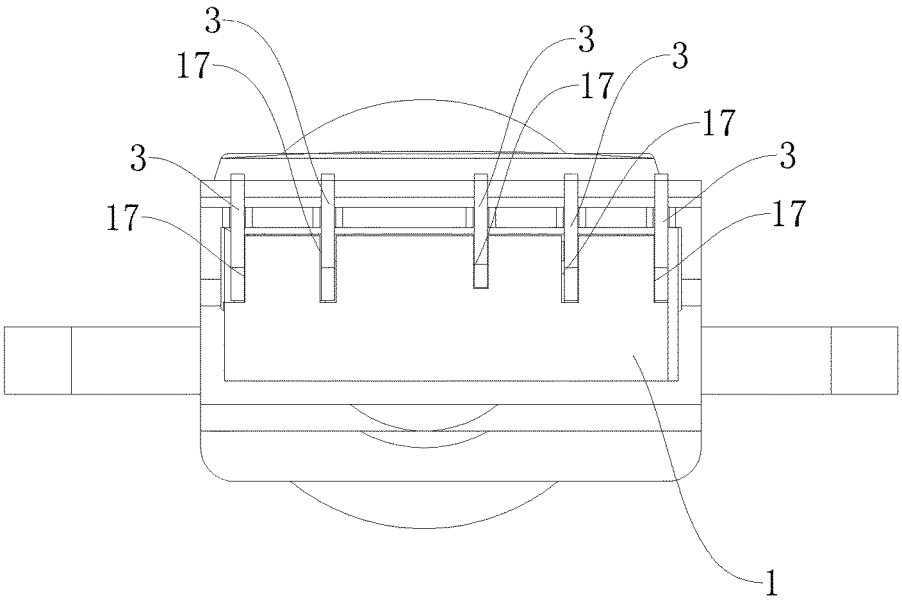
FIG. 3 is a schematic view of an earphone socket from still another angle according to an embodiment of the present disclosure.
Figure 6:
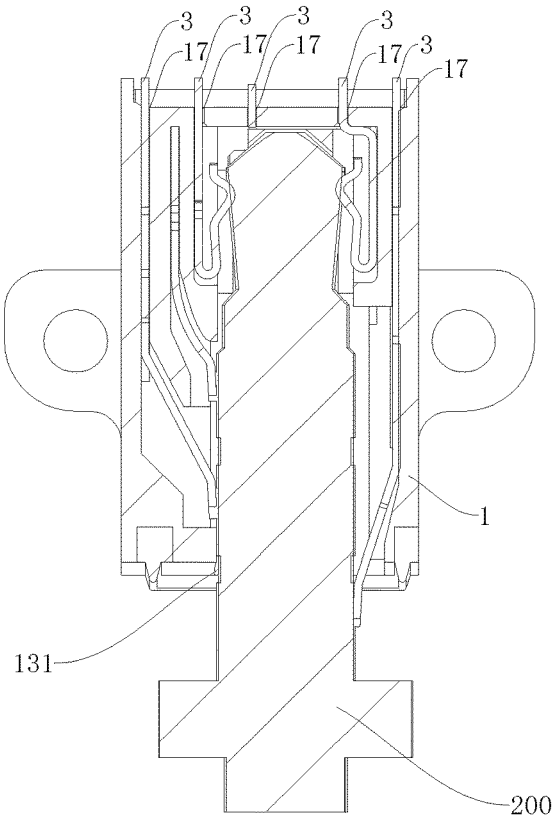
FIG. 6 is a sectional view of an earphone socket from another angle according to an embodiment of the present disclosure.

In some embodiments of the present disclosure, as illustrated in FIGS. 3 and 6, the housing 1 is provided with a plurality of mounting holes 17 through which pins 3 pass. The plurality of mounting holes 17 are located in a common side wall of the housing 1. A first end of each pin 3 located in the insertion hole 13 can be connected with the earphone plug 200, and a second end of each pin 3 extending out of the mounting hole 17 can be electrically connected with the circuit board, so as to realize an electrical connection between the earphone plug 200 and the circuit board. In addition, the plurality of mounting holes 17 are located in the same side wall of the housing 1, such that the pins 3 can extend out from the same side wall of the housing 1. Thus, it is convenient to save an internal space of the mobile terminal 1000, optimize a layout of components inside the mobile terminal 1000, and facilitate the electrical connection between the pins 3 and the circuit board.

An earphone socket 100 according to a specific embodiment of the present disclosure will be described with reference to FIGS. 1 to 8. The following description is only illustrative and intended to interpret the present disclosure but shall not be construed to limit the present disclosure.

As illustrated in FIGS. 1 to 8, the earphone socket 100 according to the embodiment of the present disclosure includes the housing 1 and the sealing member 2.

In an embodiment, the housing 1 includes the second peripheral side wall 11 and the first peripheral side wall 12. The wall thickness of the first peripheral side wall 12 is greater than that of the second peripheral side wall 11, and the first peripheral side wall 12 and the second peripheral side wall 11 together define the insertion hole 13 with the opening port 131 at one end. The first peripheral side wall 12 and the second peripheral side wall 11 are arranged along the central axis of the insertion hole 13, and the opening port 131 is located in the second peripheral side wall 11. The sealing member 2 is embedded on the outer surface of the housing 1. The sealing member 2 surrounds the periphery of the opening port 131, and at least part of the sealing member 2 extends to the first peripheral side wall 12. Therefore, when the earphone socket 100 is assembled to the mobile terminal 1000, it is possible to prevent the fluid (e.g. water) outside the mobile terminal 1000 from entering the mobile terminal 1000 along the outer surface of the housing 1, and hence avoid damaging the circuit board or the like inside the mobile terminal 1000, thereby improving the operational reliability of the mobile terminal 1000. Furthermore, there is no need to increase the wall thickness of the second peripheral side wall 11 and form the sealing groove in the second peripheral side wall 11, so as to reduce the overall thickness of the earphone socket 100 and facilitate the light and thin design of the mobile terminal 1000. Moreover, it is possible enhance the structural strength of the housing 1, and improve the waterproof and dustproof reliability of the earphone socket 100.

As illustrated in FIGS. 4 and 5, the housing 1 is provided with the embedding groove 14. The sealing member 2 is made of silica gel and includes the embedded portion 21 and the protruding portion 22. The embedded portion 21 is embedded into the embedding groove 14 to fix the sealing member 2. The protruding portion 22 is connected with the embedded portion 21 and located outside the embedding groove 14. When the earphone socket 100 is assembled to the mobile terminal 1000, the embedded protrusion 211 can separate the interior of the mobile terminal 1000 from the exterior thereof, so as to prevent the fluid (e.g. water) outside the mobile terminal 1000 from entering the mobile terminal 1000 along the outer surface of the housing 1 of the earphone socket 100, and hence avoid damaging the circuit board or the like inside the mobile terminal 1000. In addition, the embedding groove 14 is provided with at least one embedding recess therein in communication with the embedding groove 14, and the embedded portion 21 is provided with at least one embedded protrusion 211 fitted with the at least one embedding recess, so as to increase the mating area between the sealing member 2 and the outer surface of the housing 1, thereby improving an effect of fixing the sealing member 2. The embedded protrusion 211 is provided at the side of the embedded portion 21 away from the opening port 131, and the shape of the embedded protrusion 211 is not limited herein. In an embodiment the embedded protrusion 211 is injection-molded on the housing.

As illustrated in FIGS. 4 and 5, in the direction from the fixed end of the protruding portion 22 to the free end thereof, the width of the protruding portion 22 is gradually decreased. The end face of the free end of the protruding portion 22 is formed as an arc surface. Therefore, it is possible to increase a fitting degree between the protruding portion 22 and the outer surface of the component inside the mobile terminal 1000, thereby improving the waterproof and dustproof effect of the sealing member 2.

As illustrated in FIGS. 2 and 5, the housing 1 has the first surface 15 including a surface of a part of the second peripheral side wall 11, and the second surface 16 including a surface of another part of the second peripheral side wall 11 and a part of the first peripheral side wall 12. The first surface 15 is adjacent to the second surface 16, and the opening port 131 is located in the first surface 15. The part of the second surface 16 close to the first surface 15 is formed as an inclined surface. The sealing member 2 includes the first segment 23, the second segment 24 and two connecting segments 25. The first segment 23 is embedded on the first surface 15 and is close to the opening port 131; the second segment 24 is embedded on the second surface 16; the two connecting segments 25 are connected between the first segment 23 and the second segment 24 to constitute the ring sealing member 2.

The first segment 23 and the second segment 24 extend in the same direction. The length of the first segment 23 is greater than that of the second segment 24, and correspondingly, the length of the first part of the embedding groove 14 for containing the first segment 23 is greater than that of the second part of the embedding groove 14 for containing the second segment 24. Thus, it is possible to not only simplify the structure of the housing 1, but also reduce the length of the second part of the embedding groove 14 for containing the second segment 24, thereby further improving the structural strength of the housing 1. Each connecting segment 25 includes the straight segment 251 and the transition segment 252. The first end of the straight segment 251 is connected with the first segment 23, and the extension direction of the straight segment 251 is perpendicular to the extension direction of the first segment 23. The first end of the transition segment 252 is connected with the second end of the straight segment 251, and the second end of the transition segment 252 is connected with the second segment 24. In the direction towards the interior of the insertion hole 13, the transition segment 252 is gradually inclined towards the central axis of the insertion hole 12.

As illustrated in FIGS. 3 and 6, the housing 1 is provided with a plurality of mounting holes 17 through which the pins 3 pass. The plurality of mounting holes 17 are located in the common side wall of the housing 1. The first end of each pin 3 located in the insertion hole 13 can be connected with the earphone plug 200, and the second end thereof extending out of the mounting hole 17 can be electrically connected with the circuit board, so as to realize the electrical connection between the earphone plug 200 and the circuit board. In addition, the plurality of mounting holes 17 are located in the same side wall of the housing 1, such that the pins 3 can extend out from the same side wall of the housing 1. Thus, it is convenient to save the internal space of the mobile terminal 1000, optimize the layout of components inside the mobile terminal 1000, and facilitate the electrical connection between the pins 3 and the circuit board.

In the following, a method for manufacturing an earphone socket 100 according to embodiments of the present disclosure will be described with reference to FIGS. 1 to 8.

The earphone socket 100 includes a housing 1 and a sealing member 2 embedded on the outer surface of the housing 1. The housing 1 is provided with an insertion hole 13 having an open end. The sealing member 2 surrounds a periphery of the insertion hole 13. The method includes the following actions. In S10, an embedding groove 14 is machined in the housing and the sealing member 2 is embedded on the embedding groove 14; in S20, at least one embedding recess is made in the embedding groove 14, and the at least one embedding recess is in communication with the embedding groove 14; and in S30, the glue is filled in the embedding recess, and the glue is coagulated to form a glue portion, so as to fix the sealing member 2 on the housing 1.

With the method for manufacturing the earphone socket 100 according to embodiments of the present disclosure, the housing 1 and the sealing member 2 can be machined individually, and then the sealing member 2 is embedded in the embedding groove 14. The embedding recess in the housing 1 is filled with the glue to form the glue portion. The sealing member 2 is fixed on the outer surface of the housing 1 through the glue portion. This method can simplify the machining process of the housing 1 and the sealing member 2, thus reducing the cost.

A method for manufacturing the earphone socket 100 according to a specific embodiment of the present disclosure will be described with reference to FIGS. 1 to 8. It should be understood that the following description is only illustrative and intended to interpret the present disclosure but shall not be construed to limit the present disclosure.

The earphone socket 100 includes the housing 1 and the sealing member 2. The housing 1 includes a second peripheral side wall 11 and a first peripheral side wall 12. The wall thickness of the first peripheral side wall 12 is greater than that of the second peripheral side wall 11, and the first peripheral side wall 12 and the second peripheral side wall 11 together define an insertion hole 13 with an opening port 131 at one end. The first peripheral side wall 12 and the second peripheral side wall 11 are arranged along a central axis of the insertion hole 13, and the opening port 131 is located in the second peripheral side wall 11. The sealing member 2 is embedded on an outer surface of the housing 1. The sealing member 2 surrounds the periphery of the opening port 131, and at least part of the sealing member 2 extends to the first peripheral side wall 12.

As illustrated in FIGS. 4 and 5, the housing 1 is provided with the embedding groove 14. The sealing member 2 includes an embedded portion 21 and a protruding portion 22. The embedded portion 21 is embedded into the embedding groove 14. The protruding portion 22 is connected with the embedded portion 21 and located outside the embedding groove 14. The embedding groove 14 is provided with at least one embedding recess therein in communication with the embedding groove 14.

When the sealing member 2 and the housing 1 are manufactured, the embedded portion 21 of the sealing member 2 is first embedded in the embedding groove 14; then the glue is filled in the embedding recess; the glue is coagulated to form the glue portion; the glue portion can fix the sealing member 2 on the housing 1. This method can simplify the machining process of the housing 1 and the sealing member 2, thus reducing the cost.

A mobile terminal 1000 according to embodiments of the present disclosure will be described with reference to FIGS. 1 to 8.

The mobile terminal 1000 according to embodiments of the present disclosure includes the earphone socket 100. By providing the earphone socket 100, it is possible to prevent the fluid (e.g. water) outside the mobile terminal 1000 from entering the mobile terminal 1000 along the outer surface of the housing 1 of the earphone socket 100, and hence avoid damaging the circuit board or the like inside the mobile terminal 1000, thus enhancing the operational reliability of the mobile terminal 1000. Furthermore, there is no need to increase the wall thickness of the second peripheral side wall 11 and form the sealing groove in the second peripheral side wall 11, so as to reduce the overall thickness of the earphone socket 100 and facilitate the light and thin design of the mobile terminal 1000. Moreover, it is possible enhance the structural strength of the housing 1, and improve the waterproof and dustproof reliability of the earphone socket 100.

In some embodiments of the present disclosure, the mobile terminal 1000 can be a mobile phone, a tablet computer, a notebook computer and so on.

Reference throughout this specification to "an embodiment", "some embodiments", "an example", "a specific example" or "some examples" means that a particular feature, structure, material, or characteristic described in connection with the embodiment or example is included in at least one embodiment or example of the present disclosure. Thus, the appearances of the above phrases throughout this specification are not necessarily referring to the same embodiment or example of the present disclosure. Furthermore, the particular features, structures, materials, or characteristics can be combined in any suitable manner in one or more embodiments or examples. Moreover, different embodiments or examples as well as the features in the different embodiments or examples described in the specification can be combined or united by those skilled in the related art in the absence of contradictory circumstances.

Although embodiments of the present disclosure have been shown and illustrated, it shall be understood by those skilled in the art that the above embodiments are explanatory and cannot be construed to limit the present disclosure, and changes, modifications, alternatives and variants can be made in the embodiments without departing from the scope of the present disclosure.

What is claimed is:

1. A mobile terminal, comprising an earphone socket and a display screen, the display screen being spaced apart from the earphone socket, the earphone socket comprising:

a housing having an insertion hole surrounded by a peripheral side wall and provided with an embedding groove, the peripheral side wall having a first peripheral side wall located at an inner portion of the insertion hole and a second peripheral side wall located at an outer portion of the insertion hole, the first peripheral side wall having a thickness greater than that of the second peripheral side wall, and the second peripheral side wall having an opening port at an outer end of the insertion hole; and a sealing member embedded on an outer surface of the housing, and surrounding a periphery of the opening port, and at least a part of the sealing member extending to the first peripheral side wall, wherein the housing comprises a first surface comprising a surface of a part of the second peripheral side wall, and a second surface comprising a surface of another part of the second peripheral side wall and a part of the first peripheral side wall; the first surface is adjacent to the second surface; the opening port is located in the first surface; and the sealing member comprises:

a first segment embedded on the first surface and close to the opening port;

a second segment embedded on the second surface; and two connecting segments connected between the first segment and the second segment to constitute a ring sealing member.

2. The mobile terminal according to claim 1, wherein the first segment and the second segment extend in a common direction, the first segment has a length greater than a length of the second segment; and the connecting segment comprises:

a straight segment having a first end connected with the first segment and extending in a direction perpendicular to an extension direction of the first segment; and a transition segment having a first end connected with a second end of the straight segment and a second end connected with the second segment, and gradually inclined towards the central axis in a direction towards an interior of the insertion hole.

3. The mobile terminal according to claim 2, wherein a first part of the embedding groove for containing the first segment has a length greater than a length of a second part of the embedding groove for containing the second segment.

4. The mobile terminal according to claim 1, wherein a part of the second surface close to the first surface is configured as an inclined surface.

5. The mobile terminal according to claim 1, wherein a part of the second surface close to the first surface is configured as an arc surface.

6. The mobile terminal according to claim 1, wherein the sealing member is made of silica gel.

7. The mobile terminal according to claim 1, wherein the sealing member is injection-molded on the housing.

8. The mobile terminal according to claim 1, wherein the housing is provided with a plurality of mounting holes through which pins pass, and the plurality of mounting holes are located in a same side wall of the housing.

9. The mobile terminal according to claim 1, wherein the sealing member comprises an embedded portion embedded in the embedding groove and a protruding portion connected with the embedded portion and located outside the embedding groove, and at least a part of the sealing member extends to the first peripheral side wall.

10. The mobile terminal according to claim 9, wherein an end face of a free end of the protruding portion is configured as an arc surface.

11. The mobile terminal according to claim 10, wherein the arc surface of the end face of the free end of the protruding portion protrudes in a direction away from the embedded portion.

12. The mobile terminal according to claim 10, wherein in a direction from a fixed end of the protruding portion to the free end of the protruding portion, a width of the protruding portion is gradually decreased.

13. The mobile terminal according to claim 1, wherein the embedding groove is provided with at least one embedding recess therein in communication with the embedding groove, and the sealing member is provided with an embedded protrusion fitted with the at least one embedding recess.

14. The mobile terminal according to claim 13, wherein the embedded portion is provided with a plurality of embedded protrusions, and the plurality of embedded protrusions are spaced apart in a circumferential direction of the sealing member.

15. The mobile terminal according to claim 14, wherein the plurality of embedded protrusions are connected with the embedded portion and located at a side of the embedded portion away from the opening port.

16. The mobile terminal according to claim 15, wherein the sealing member is injection-molded into the embedding groove together with the embedded protrusion.

17. The mobile terminal according to claim 1, wherein the embedding groove is provided with at least one embedding recess therein in communication with the embedding groove, and the at least one embedding recess is provided with a glue portion for bonding the sealing member to the housing.

18. The mobile terminal according to claim 1, wherein the mobile terminal is configured as one of a mobile phone, a tablet computer and a notebook computer.

19. The mobile terminal according to claim 1, wherein the housing and the sealing member are machined individually.

* * * * *